United States Patent [19]

Keenan et al.

[11] Patent Number: 4,579,262

[45] Date of Patent: Apr. 1, 1986

[54] HANGER BAR ASSEMBLY FOR SOCKS

[75] Inventors: Paul B. Keenan, Millburn; Barry T. Fisher, Long Valley, both of N.J.

[73] Assignee: Chipman-Union, Inc., Union Point, Ga.

[21] Appl. No.: 519,249

[22] Filed: Aug. 1, 1983

[51] Int. Cl.[4] ..... A47J 51/093

[52] U.S. Cl. ..... 223/85; 211/94.5; D6/315

[58] Field of Search ..... 211/94.5, 113, 119; 248/359; 223/DIG. 1, 85, 87, 95, 96, 91; 206/289–291, 284–287.1, 300; D6/315, 327

[56] References Cited

U.S. PATENT DOCUMENTS

| | | | |
|---|---|---|---|
| D. 221,311 | 7/1971 | Hart | D6/315 |
| D. 229,811 | 1/1974 | Laughton | D6/327 |
| 794,176 | 7/1905 | Hamilton | 223/96 |
| 1,799,690 | 4/1931 | Kanowitz | 223/87 X |
| 2,164,534 | 7/1939 | Luhn | 223/85 |
| 3,217,893 | 11/1965 | Fleischman | 211/94.5 |
| 3,327,912 | 6/1967 | Blair | 223/85 |
| 3,458,093 | 7/1969 | Bacharach | 223/87 |
| 3,512,688 | 5/1970 | Bacharach | 223/95 |
| 3,925,014 | 12/1975 | Langdon | 211/13 X |
| 4,467,926 | 8/1984 | Percival | 211/94.5 X |

FOREIGN PATENT DOCUMENTS

| | | | |
|---|---|---|---|
| 250232 | 3/1964 | Australia | 223/87 |
| 710684 | 6/1954 | United Kingdom | 223/96 |

*Primary Examiner*—Robert R. Mackey

*Attorney, Agent, or Firm*—Newton, Hopkins & Ormsby

[57] ABSTRACT

A pair of spaced, parallel, horizontal support bars suspend, therebetween, a plastic hanger bar assembly over which a sock or socks are draped. The hanger bar assembly has a pair of downwardly opening hooks carrying, therebetween an inclined support bar, reinforced by a web extending beneath the bar. Opposed inwardly protruding fingers above and parallel to the hanger bar hold the sock in place.

2 Claims, 3 Drawing Figures

HANGER BAR ASSEMBLY FOR SOCKS

BACKGROUND OF THE INVENTION

1. Field of the Invention

This invention relates to a hanger bar assembly for socks and is more particularly concerned with a hanger which is capable of supporting one or a plurality of socks for display in a store.

2. Description of the Prior Art

In the past, various forms of hooks and clamps have been employed for supporting socks. One such hook or clamp is known as a "J" hook. This device is a long rod-like member, the upper end portion of which is curled to form a loop and the lower portion of which is reversely bent and extends horizontally to form a clamp-like member into which the socks can be inserted. Another prior art device is known as an "S" hook. This device is simply an open ended hook having a hole at the distal end. A length of plastic is inserted through the hole and through the socks to hold the socks in place.

Still another type of support for hose includes a clamp hook which comprises a hook portion extending upwardly and carrying a downwardly opening clamp which is biased to a closed position. Still another form of hosiery supporting device includes what is known as a SWIFTAC hook. This device includes a conventional hook to which a single strand of plastic is affixed. The strand passes through the socks so that the hook supports the socks.

The general disadvantage of the prior devices is that they do not readily support the sock in a laterally extended position, at all times and they do not support the sock hanging pendant in a vertical position.

Another problem with the prior art devices is that they do not lend themselves to being disengaged from each other when they are randomly packed.

SUMMARY OF THE INVENTION

Briefly described, the present invention includes a hanger bar assembly which is supported by a pair of spaced, parallel, horizontally disposed support rods, the hanger bar assembly being suspended, therebetween. The hanger bar assembly, itself, is a unitary plastic member having a straight hanger bar, provided at opposite ends with likewise, i.e., downwardly opening U-shaped hooks. In the preferred embodiment, the hooks support the bar, inclined at an angle, and the bottom portion of the bar is reinforced by an arcuate web or rib. The loop of the hook for one hook is offset from the bar and offset from the loop of the other hook.

Extending from an intermediate portion of the upstanding lower or first hook is a retaining finger which protrudes in spaced generally parallel relationship over the lower portion of the hanger bar. Extending from the upper portion of either the upper hook or the hanger bar is an L-shaped member which protrudes upwardly and then inwardly, the inwardly extending portion forming a finger which is generally aligned with the lower finger and parallel to the hanger bar for retaining the socks in place.

Accordingly, it is an object of the present invention to provide a hanger bar assembly for hosiery which is inexpensive to manufacture, durable in structure and efficient in operation.

Another object of the present invention is to provide a hanger bar assembly which will retain socks in a neat vertically pendant position for display.

Another object of the present invention is to provide a hanger bar assembly on which socks can be disposed in such a position that the sock will not readily slide off or become inadvertently disengaged.

Another object of the present invention is to provide a hanger bar assembly for supporting socks in such an arrangement that it does not damage the fabric of the sock.

Another object of the present invention is to provide a hanger bar assembly which does not readily break.

Another object of the present invention is to provide a hanger bar assembly which, when packed with other similar hanger bars, can be readily separated from each other for use.

Another object of the present invention is to provide a hanger bar assembly which does not readily separate from the sock.

Another object of the present invention is to provide a hanger bar assembly which will essentially eliminate the hazard of loose hooks falling on the floor.

Another object of the present invention is to provide a hanger bar assembly which does not readily release the sock which it is supporting so that the sock falls on the floor.

Another object of the present invention is to provide a hanger bar assembly which supports socks so that they do not sag in their central portion.

Other objects, features and advantages of the present invention will become apparent from the following description when taken in conjunction with the accompanying drawings wherein like chaaracters of reference designate corresponding parts throughout the several views.

DESCRIPTION OF THE PREFERRED EMBODIMENTS

Figure 1:
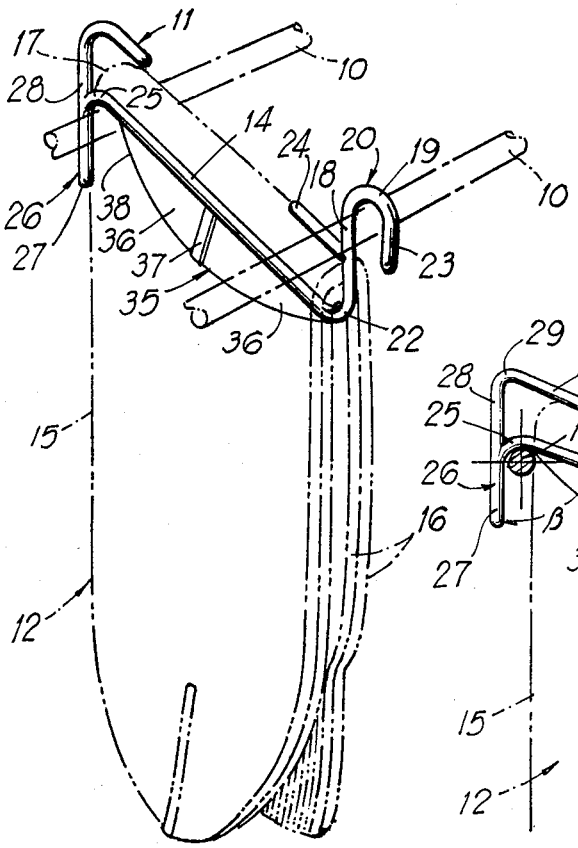
FIG. 1 is a perspective view of a hanger bar assembly constructed in accordance with the present invention, the socks, which the hanger bar is supporting, being shown in broken lines and the rods which support the bar assembly being shown in broken lines.
Figure 2:
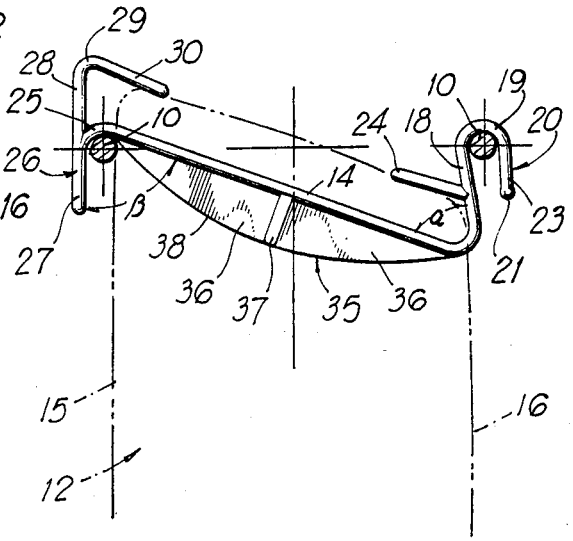
FIG. 2 is a side elevational view of the hanger bar assembly depicted in FIG. 1, the socks being shown in broken lines.

Referring now in detail to the embodiments chosen for the purpose of illustrating the present invention, numeral 10 in FIGS. 1 and 2 denote generally a pair of spaced, parallel, horizontally disposed, support rods on which the hanger bar assembly of the present invention, denoted generally by numeral 11, is disposed. It will be understood that a number of such hanger bar assemblies 11 will be draped over the support rods 10 so as to display a number of socks or hosiery, denoted generally by the numeral 12.

In more detail, the hanger bar assembly 11 is an injection molded, unitary or integral member which includes a central, straight, generally cylindrical, hanger bar 14, which is of a length greater than the width of a sock 12 and is disposed at an inclined angle from the horizontal of about 30°. This angle of inclination of bar 14 can vary from about 20° to about 40° from the horizontal so as to suspend a pair of socks 12, folded about its heel portion, in a generally vertical position as depicted in FIGS. 1 and 2. The incline angle is dictated by the difference in the length of the sock 12 along the rear portion 15 and the length along the front portion 16 thereof, so that the heel of the sock is supported at a position elevated from the opposite side when an intermediate portion of the sock or socks 12, which includes the heel, is draped over the bar 14, as illustrated in FIG. 1.

The first or lower end of the bar 14 is provided with an inverted, U-shaped, downwardly opening hook 20, having an upstanding inner bar 18 which is joined, at an acute angle $\alpha$, to the end of bar 14 by a curved sock receiving elbow 22. Thence, bar 18 extends upwardly and inwardly, terminating in a downwardly opening, concaved, crescent shaped rod engaging loop or support member 19. Thereafter, the support member 19 merges into a straight downwardly extending generally vertically disposed outer retaining bar 23 which is spaced from but converges slightly toward the upstanding bar 18. Thus, bars 18 and 23 form opposed legs of hook 20. The lower end 21 of the retaining bar 23 terminates above the arcuate sock receiving elbow 22 so that the loop 19 is offset upwardly from the bar 14. The space between the end 21 and bar 18 is less than the diameter of a support bar 10 and the plastic is sufficiently resilient that bar 23 is momentarily deformed outwardly, within its elastic limits when hook 20 is inserted over rod 10.

Intermediate the upper and lower ends of the upstanding bar 18, an upwardly inclined retaining finger 24 protrudes, in cantilever fashion, over the lower end portion of the bar 14, the finger 24 being generally parallel to or converging slightly toward the bar 14, as illustrated in FIG. 2. Thus, the finger 24 and the lower portion of bar 18 form a bracket for arresting either appreciable movement of socks 12 along rod 14 or outward movement of sock 12.

The upper or second end portion of the bar 14 has the second downwardly opening U-shaped hook, denoted by numeral 26. Hook 26 includes a support bar engaging loop or support member 25 which curves arcuately outwardly and downwardly from the end of bar 14, the rod engaging loop 25 terminating at an intermediate portion of a vertically disposed or upright cylindrical guide bar. The lower end portion 27 of the guide bar is disposed generally vertically, being at an acute angle $\beta$ with respect to bar 14. End portion 27 thus forms a downwardly protruding arm which is disposed outwardly of the rod 10 when the upper hook 26 is draped over one of the support rods 10.

A second bracket is formed by the upper portion 28 of the vertical bar which protrudes upwardly beyond the rod 14 and is bent at its upper end at an acute angle so as to form an elbow 29, from which protrudes an inwardly extending finger 30, the finger 30 being generally in alignment with and extends toward the finger 24, sufficiently that a pair of socks 12 can be inserted onto bar 14 through the space between fingers 24 and 30 so that the fingers 24 and 30 extend over the outer portions of the sock 12. Furthermore, the fingers 24 and 30, as well as the hook members 20 and 26, are in common vertical plane with the bar 14.

The distance from the upstanding member 18 to the bar 28 is greater than to the width of a pair of socks, as measured from the heel portion 15 to the opposite front portion 16. The distance between the fingers 24 and 30 and the bar 14 is approximately equal to the thickness of a pair of socks 12.

Integrally formed with the bar 14 and extending downwardly from its lower edge portion is a reinforcing rib, denoted generally by the numeral 35. This reinforcing rib 35 has a pair of body portions 36 which protrude downwardly and are joined by a cylindrical reinforcing rod 37 of about the same diameter as bar 14. Rod 36 protrudes radially or perpendicularly from the approximate mid portion of rod 14, the reinforcing rod 37 joining the abutting ends of the rib bodies 36. Thus, the lower edge 38 of the rib 35 forms a continuous arc which defines the concaved lower surface for the reinforcing rib 35. The reinforcing rib 35 thus strengthens the bar 14 so as to prevent any appreciable sagging of the bar when its supports the socks 12.

Figure 3:
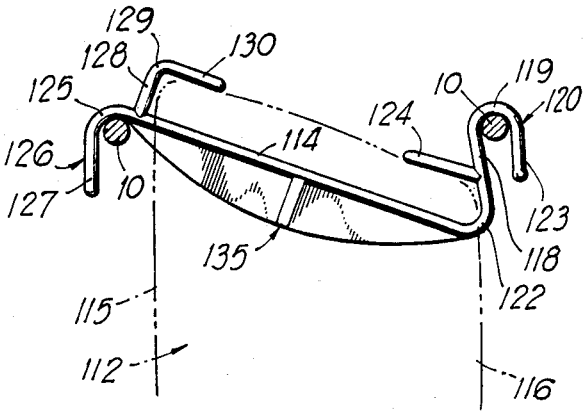
FIG. 3 is a side elevational view showing a modified form of the present invention, the socks being depicted in broken lines.

In the modified form of the present invention, as depicted in FIG. 3, there is an inclined rod 114 provided with a a downwardly open hook 120 which is identical to hook 20 having an inner bar 118 with a finger 124 which is identical to finger 24. Furthermore, the rod 114 is provided with a reinforcing rib 135 which is identical to rib 35. According to this embodiment, the upper hook 126 is formed by an extension of the rod 114, the rod 114 merging into an arcuately, outwardly and downwardly extending, support rod engaging loop 125 and a downwardly depending guide bar 127 which terminates in a plane generally horizontal to the lower end of the bar 114.

An L-shaped upstanding and inwardly extending bracket protrudes from the upper surface of the bar 114, this L-shaped member including an upstanding bar 128 which is joined by an elbow 129 to an inwardly extending finger 130. The fingers 124 and 130 are generally in alignment with and spaced from each other, and being also spaced generally parallel to and above the bar 114.

By the arrangement shown in FIG. 3, the socks 112 are carried on bar 114 and any appreciable movement along the length of bar 114 is arrested by the upstanding inner bar 118 of hook 120 and the upstanding portion of bar 128.

In use, the loop or support member 119 of hook 120 and the loop or support member 125 of hook 126 engage respectively, rod 10, so as to support the sock 112 in a downwardly depending fashion, the socks 112 being disposed between the rods 10. The bars 18, 23, 26, 18, 123, 126, the elbows 22, 25, 29, 122, 125, 129 and the fingers 24, 30, 130, 124 are all cylindrical in cross-section and are of about the same diameter as bars 14 and 114.

In use, one or a plurality of socks 12 or 112 are draped over the bar 14 or 114 so that the sock or socks 12 or 112 are between the bar 14 or 114 and the fingers 24, 30 or 124, 130. The hanger assembly is then placed on the parallel bars 10, the hook 20 or 120 being inserted first so that the hook 26 or 126 tends to pivot into place resting on the other rod 10. The loop 19 or 119 is offset appreciably above its end of bar 14 or 114 and the loop 25 or 125 is offset slightly below its end of bar 14 or 114. The socks 12 or 112 are therefore hung inclined by bar 14 or 114, between the rods 10, generally vertically pendant from bars 14 or 114. Appreciable sliding movement of the socks 12 or 112 is arrested by fingers 24, 30 or 124, 130. It will be obvious that while our present hanger is particularly suited to the display of socks or hosiery, other flexible articles can be supported on the hanger bar assembly draped over bar 14 or 114 and hanging pendant therefrom on both sides of bar 14 or 114.

The structure of both the embodiment of FIGS. 1 and 2 and the embodiment of FIG. 3 is such that, when the loops 19 and 25 or 119 and 125 are disposed over rods 10, the center of gravity of the hanger assembly is below the rods and loops 19, 25, 119, 125. Thus, the hanger assemblies tend to remain in a vertical plane.

It will be obvious to those skilled in the art that many variations may be made in the embodiments here chosen for the purpose of illustrating the present invention, without departing from the scope thereof as defined by the appended claims.

We claim:

1. Hanger bar assembly comprising:

(a) a hanger bar for receiving and supporting a sock draped over said hanger bar when said hanger bar is disposed at an incline to the horizontal; and (b) a pair of generally U-shaped hooks respectively at the ends of said hanager bar, said hooks both opening downwardly, the hook at one end of said hanger bar including a guide bar and an arcuate support loop for joining said one end of said hanger bar and said guide bar and for disposing said guide bar at an acute angle to said hanger bar, the other of said hooks being at the other end of said hanger bar, said other of said hooks having a second loop spaced away from said hanger bar and a bar joining the end of said second loop to its associated end of said hanger bar so as to dispose said hanger bar at a prescribed inclination when said hooks are respectively disposed over parallel support rods, whereby said guide bar extends generally in a vertical direction outwardly of its associated end of said support rod;

(c) said other of said pairs of hooks includes an upright inner bar and an upright outer bar, said loop joining the ends of said inner bar and said outer bar, said inner bar being connected by its other end to one end of said hanger bar; and (d) an upstanding L-shaped bracket mounted on said hanger bar adjacent to said hook at the one end of said hanger bar and a finger generally aligned with one portion of said bracket, said finger extending from an intermediate portion of said other of said hooks.

2. A hanger bar assembly comprising:

(a) a hanger bar for receiving and supporting a flexible article draped over said hanger bar and hanging pendant therefrom on both sides of said hanger bar;

(b) a pair of generally U-shaped hooks on the ends of said hanger bar, said U-shaped hooks opening in the same direction sidewise of said hanger bar for being inserted respectively over and supported by a pair of spaced parallel, horizontally disposed support rods, whereby the flexible article which is draped over said hanger bar will be held suspended by said bar between said hooks, one of said hooks including a pair of legs and a loop joining said legs, said legs being spaced apart from each other, one of said legs having an end integrally joined to the end of said bar, said one of said legs being of sufficient length that said loop is offset from said bar on one side of said bar, the other of said hooks including a second loop and a guide bar joined to the end of said second loop;

(c) a reinforcing web along the lower surface of said bar, said reinforcing web having an arcuate outer edge;

(d) an upstanding L-shaped bracket mounted on said hanger bar adjacent to said other of said hooks, and a finger generally aligned with one portion of said bracket, said finger extending from an intermediate portion of said one of said hooks.

* * * * *